US006874302B2

(12) United States Patent
Gambetti

(10) Patent No.: US 6,874,302 B2
(45) Date of Patent: Apr. 5, 2005

(54) SLEEVE TYPE PACKAGING MACHINE SYSTEM, PARTICULARLY USEFUL FOR CHANGING REELS

(75) Inventor: Mario Gambetti, Castelfranco Emilia (IT)

(73) Assignee: Baumer S.r.l., Castelfranco Emilia (IT)

( * ) Notice: Subject to any disclaimer, the term of this patent is extended or adjusted under 35 U.S.C. 154(b) by 0 days.

(21) Appl. No.: 10/692,882

(22) Filed: Oct. 24, 2003

(65) Prior Publication Data

US 2004/0083690 A1 May 6, 2004

(30) Foreign Application Priority Data

Nov. 4, 2002 (IT) ..... BO2002A0693

(51) Int. Cl.[7] ..... B65B 13/04
(52) U.S. Cl. ..... 53/589; 53/389.1; 53/210
(58) Field of Search ..... 53/465, 589, 588, 53/210, 216, 389.1–389.5; 83/648–650, 949, 937, 436.5, 436.7, 436.9, 436.75; 242/557, 559.3, 527, 533.8

(56) References Cited

U.S. PATENT DOCUMENTS

| | | | | | |
|---|---|---|---|---|---|
| 2,988,944 | A | * | 6/1961 | Bevier | 83/233 |
| 3,318,066 | A | * | 5/1967 | Seragnoli | 53/53 |
| 3,791,100 | A | * | 2/1974 | Monaghan | 53/74 |
| 3,983,774 | A | * | 10/1976 | Seragnoli | 83/289 |
| 4,075,815 | A | * | 2/1978 | Carver et al. | 53/463 |
| 4,185,442 | A | * | 1/1980 | Johnson et al. | 53/168 |
| 4,541,221 | A | * | 9/1985 | Seragnoli | 53/396 |
| 5,203,144 | A | * | 4/1993 | Gambetti | 53/465 |
| 5,272,853 | A | * | 12/1993 | Francioni et al. | 53/64 |
| 5,463,846 | A | * | 11/1995 | Gambetti | 53/465 |
| 5,613,351 | A | * | 3/1997 | Hamers et al. | 53/550 |
| 6,128,888 | A | * | 10/2000 | Gambetti | 53/465 |
| 6,474,041 | B1 | * | 11/2002 | Gambetti | 53/141 |
| 6,655,252 | B2 | * | 12/2003 | Epple | 83/732 |
| 6,722,103 | B2 | * | 4/2004 | Gambetti | 53/411 |
| 6,767,318 | B2 | * | 7/2004 | Spatafora et al. | 493/303 |

FOREIGN PATENT DOCUMENTS

GB 2 241 483 9/1991

* cited by examiner

*Primary Examiner*—Rinaldl I. Rada
*Assistant Examiner*—Hemant M. Desai
(74) *Attorney, Agent, or Firm*—Herbert Dubno

(57) ABSTRACT

A sleeve-type packaging machine system comprises: first (10) second (20) and third (30) article conveyor means, piece wrapping means (40), piece conveyor means (50) with a conveyor belt (51), a first modular unit (T100-G100) for forming and feeding pieces (S1) of packaging material, and a second modular unit (T200-G200) for forming and feeding pieces (S2) of packaging material. The said two modular units (T100-G100; T200-G200) can assume at least two transverse positions, namely a first position in which the modular unit (T100-G100; T200-G200) is positioned at least transversely at the side of the packaging machine, and a second position, in which the modular unit (T100-G100; T200-G200) is positioned under the packaging machine.

22 Claims, 4 Drawing Sheets

SLEEVE TYPE PACKAGING MACHINE SYSTEM, PARTICULARLY USEFUL FOR CHANGING REELS

DESCRIPTION

The present invention relates to a sleeve type packaging machine system, particularly but not exclusively useful for changing reels of packaging sheet.

KNOWN ART

At the present time, in sleeve type packaging machines such as those described in U.S. Pat. No. 5,203,144, a used reel of sheet is replaced by stopping the packaging cycle, after which the used reel is replaced with a new one, a front portion of the new sheet is unwound from the new reel, the rear end of the used sheet is joined (by overlapping and gluing or by means of adhesive tape) to the front end of the new sheet, the new sheet is positioned with respect to the drive rollers, and the packaging line is then restarted.

If the sheet of packaging material carries printed patterns, the aforesaid operations must also include a correct joining of the front to the rear ends with respect to the printing, and also a subsequent operation of ensuring that the printing on the new printed sheet is synchronized with the wrapping cycle, in order to locate the printing in the correct position on the surfaces of the article to be packaged.

This known art has a number of drawbacks.

A first drawback arises from the fact that the stopping of the packaging machine causes a loss of production.

A second drawback arises from the fact that the replacement of the reel located under the packaging line, the joining of the rear end of the used sheet to the front end of the new sheet, the joining with correct positioning of the printing, the positioning of the new sheet between the drive rollers, and the bringing of the new sheet, printed or unprinted, into step are laborious, difficult and dangerous operations.

A third drawback arises from the fact that the piece of sheet incorporating the joint forms a package whose appearance is unsatisfactory.

A fourth drawback arises from the fact that any cutting of the sheet in the proximity of the joint between the rear and front ends may cause defective cutting of the piece, or damage to the cutting means, since the said means are designed and arranged to cut a single thickness of plastic sheet in normal conditions, and are therefore not suitable for cutting a double sheet, as is the case when the cut is made in the proximity of the said joint.

A fifth drawback arises from the fact that, as a result of incorrect or imprecise positioning of the new sheet between the drive rollers and between the piece forming members, when the machine is restarted the said new sheet can run incorrectly between the rollers and therefore cause jamming or an initial malfunction of the machine, with a consequent stoppage or production of defective packages. Furthermore, if the sheet has printed patterns, then sometimes, regardless of whether or not the sheet is running correctly, the packaging machine has to be stopped again, in order to make adjustments to ensure that the pieces are cut in the correct position with respect to the printing, or to ensure that a package is produced with the printing correctly positioned on the package surfaces.

The said drawbacks are particularly significant when sheets of plastic and/or flexible and/or elastic and/or smooth-surfaced material are used, since, when the machine is restarted after stopping, the new sheet is stretched and/or elongated and/or slips (with a relative movement) between the drive rollers before reaching the regular condition in which it runs and is driven, in other words the condition in which the sheet is stretched and runs correctly, thus causing errors in the formation of the pieces of sheet and in the wrapping of the articles.

A sixth drawback arises from the fact that the operation of changing the format is difficult and laborious, and sometimes requires repeated stopping and restarting of the packaging machine. This is because it is first necessary to ensure that the piece of sheet has the correct length, and also that it is cut correctly with respect to any new printing, and subsequently that the said new piece is wrapped correctly in relation to the packaging cycle, in order to obtain correctly formed packages. This drawback is particularly significant when an initial setting has to be made for a particular format that has not been used before.

A seventh drawback arises from the fact that the operations of repairing and/or overhauling and/or maintaining the means of forming and feeding the pieces of sheet require the stopping of the packaging machine.

OBJECT OF THE INVENTION

The object of the present invention is therefore to overcome the aforesaid drawbacks.

The invention, which is characterized by the claims, resolves the problem of creating a system for a sleeve-type packaging machine, which wraps pieces of packaging material around articles, in which the said packaging machine comprises first article conveyor means, for feeding the articles longitudinally in sequence and spaced apart from each other; second article conveyor means, located downstream and at a small distance from the said first article conveyor means, thus creating a first opening between the said first and the said second article conveyor means, the second means being able to receive the articles arriving from the said first article conveyor means and to carry the said articles along a wrapping plane which has an entry end and an exit end; third article conveyor means, located downstream and at a small distance from the said second article conveyor means, thus creating a second opening between the said second and the said third article conveyor means, the third means being able to receive the articles arriving from the said second article conveyor means; means for wrapping the pieces of sheet, located in the proximity of the said second article conveyor means, and comprising at least one suspended wrapping bar, orientated transversely with respect to the direction of advance of the articles, and made to move through the said first and the said second opening along an orbital path passing over the top of the said second article conveyor means, the bar being capable of carrying the pieces of wrapping material; piece conveyor means with a conveyor belt, positioned longitudinally below and in alignment in the proximity of the said first opening, for feeding the pieces of packaging material in the proximity of the said first opening; and control means for controlling and synchronizing the said operating means, in which the said system is characterized in that it comprises has a first modular unit which is located under the article conveyor means and is movable and positionable transversely with respect to the packaging machine, for forming and feeding pieces of packaging material, this unit being functionally connected to the control unit; in that it has a second modular unit which is located under the article conveyor means and is movable and positionable transversely with respect to the packaging machine, for forming and feeding pieces of packaging material, this unit being functionally connected to the control unit; and in that the said first modular unit and the said second modular unit can assume at least two transverse positions, namely a first position in which the modular unit is positioned at least transversely at the side of the packaging machine, and a second position, in which the modular unit is positioned under the packaging machine in order to feed the pieces towards and above the conveyor belt of the piece conveyor means.

The use of a system of this type yields the following results: the reel is changed automatically within the packaging cycle, without stopping the packaging machine; the used reel is replaced with a new reel without stopping the packaging machine; the reel changing, reel replacement, and other operations to be carried out on the piece forming and feeding means are made simpler and safer for the operator; any errors in synchronization between the pieces fed and the packaging cycle are automatically corrected; the means for forming and feeding the pieces can be checked without stopping the packaging machine; and the means for forming and feeding the pieces can be set and tested for new formats without stopping the packaging machine.

The advantages yielded by the present invention consist, principally, in a higher output of the packaging machine, a reduction in the number of possible accidents which might harm the operator, a more precise cutting of the pieces for feeding and wrapping around the articles, and greater functionality, degree of automation and reliability of the packaging machine.

DESCRIPTION OF THE ATTACHED FIGURES

Further characteristics and advantages of the present invention will be made clearer by the following description of a preferred embodiment, provided here purely by way of example and without restrictive intent, with reference to the figures on the attached drawings, in which.

Figure 1:
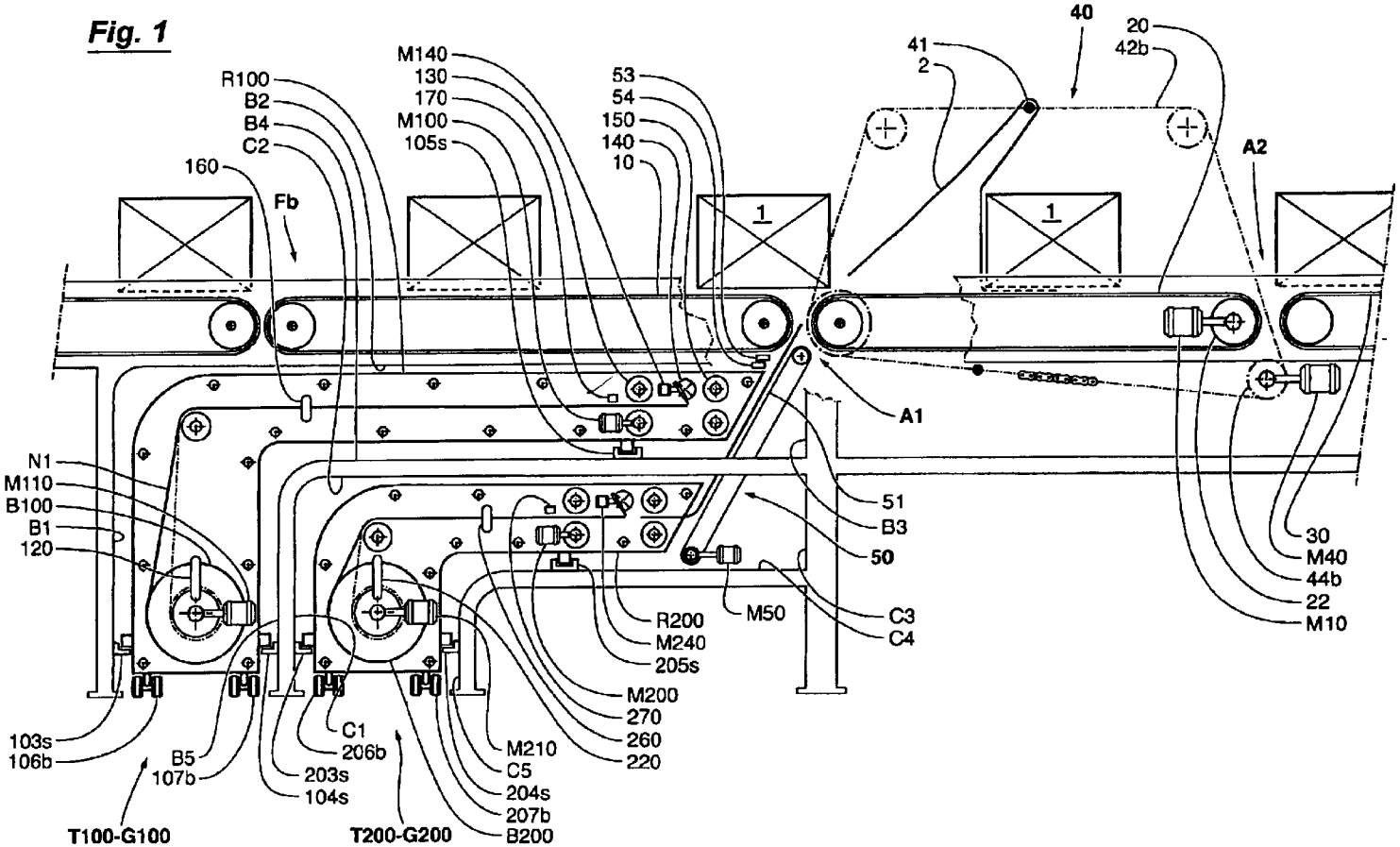
FIG. 1 shows schematically the system according to the present invention, seen from a first side of the packaging machine.
Figure 1B:
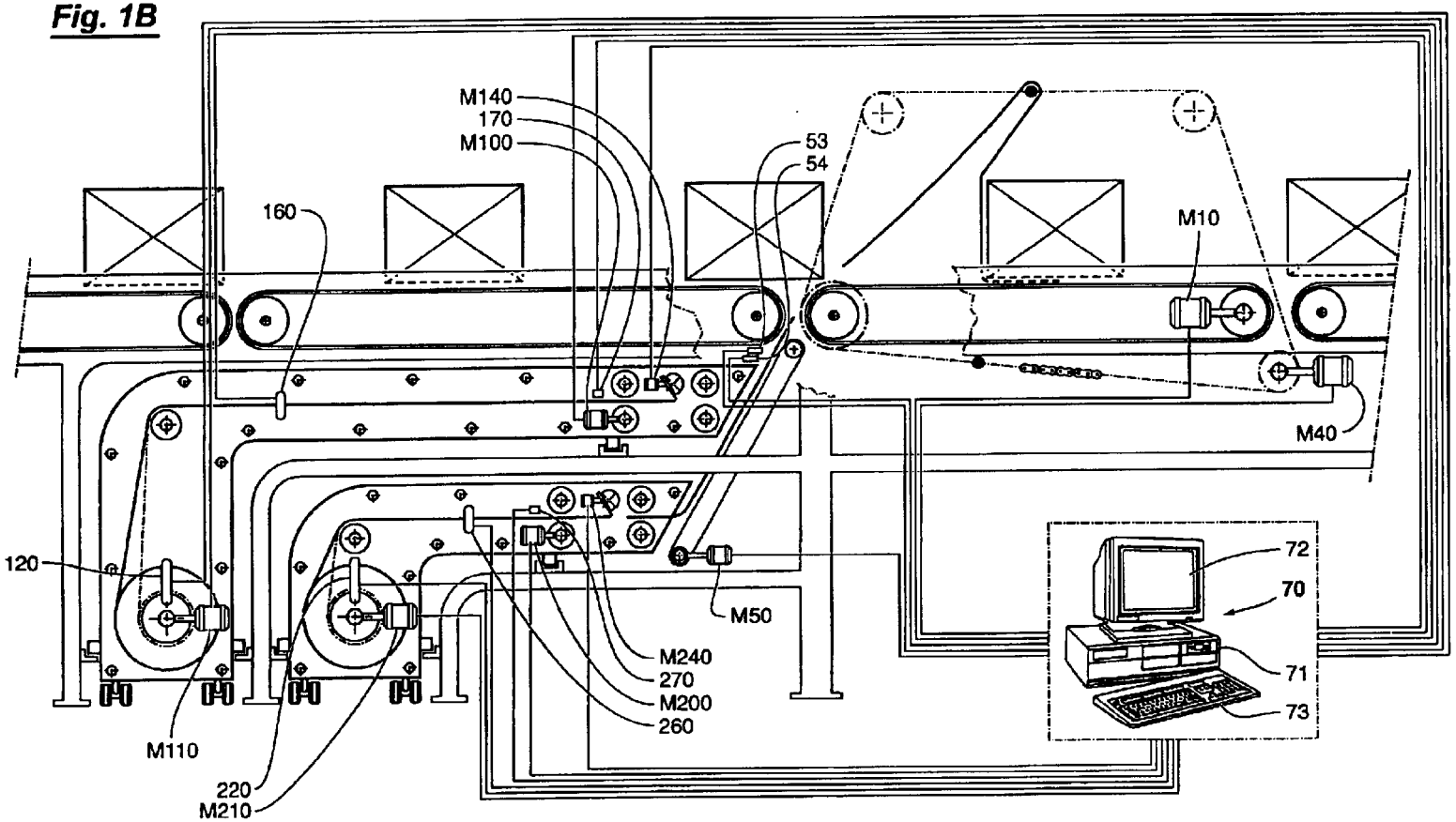
FIG. 1B shows schematically the system according to the present invention, with some connections indicated.
Figure 2:
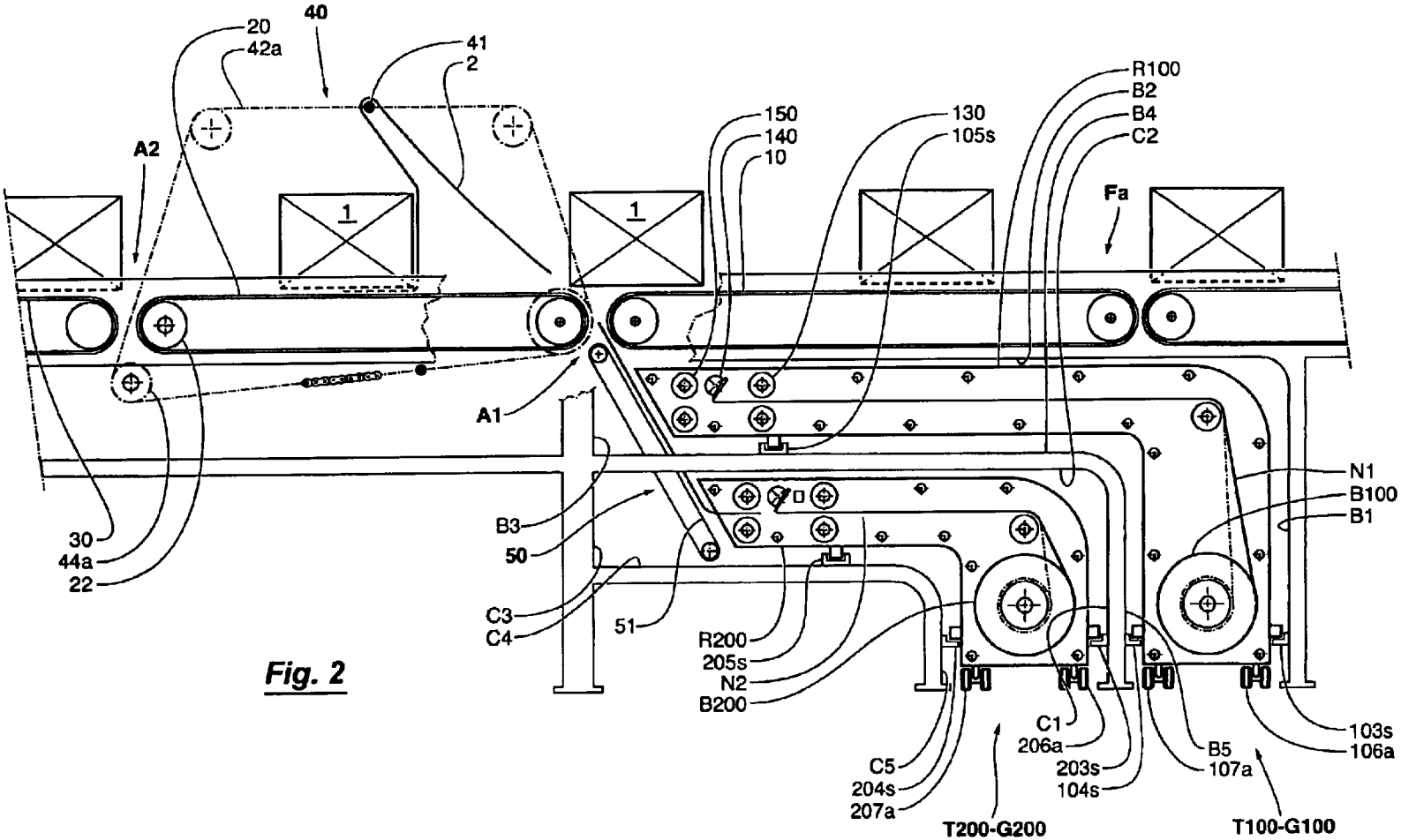
FIG. 2 shows schematically the system according to the present invention, seen from the other side of the packaging machine.

With reference to FIGS. 1, 1B and 2, these show an automatic packaging machine of the sleeve type, for wrapping the articles 1 in succession and individually with pieces 2 of packaging material, in which the said articles 1 can be in the form of single items or groups of bottles or in other forms, in which the said pieces 2 can be sheets of heat-shrinking polyethylene or the like, and in which the pieces 2 are essentially wrapped in the form of sleeves around the articles 1, the resulting assembly consisting of the article and piece 1–2 then being heat-shrunk in a heat-shrinking oven.

The said machine essentially has a fixed base or frame, comprising two longitudinally extending lateral walls, indicated here by Fa and Fb, interconnected by means of cross pieces, each of which consists of horizontal members and uprights.

The various devices forming the packaging system, consisting essentially of first article conveyor means 10, second article conveyor means 20, third article conveyor means 30, piece wrapping means 40 and piece conveyor means 50, are supported between the said walls Fa and Fb.

Conveyor Means 10, 20 and 30

The said three article conveyor means 10, 20 and 30 comprise three belt conveyors which are interconnected so that they move in unison, and which are positioned in sequence one after another and separated longitudinally by small distances in order to form a first opening A1, between the conveyors 10 and 20, and a second opening A2 between the conveyors 20 and 30.

A servo motor M10, preferably of the type with speed and phase control, such as a brushless servo motor with a servo control system, drives the three conveyors 10, 20 and 30, for example by directly driving a roller shaft 22 of the second article conveyor 20, which, in turn drives the other conveyors 10 and 30 by means of sprocket wheels and chains which are not shown. For reasons which are made clear below, the said servo motor M10 is connected to the control means 70 and is controlled by them.

Piece Wrapping Means 40

The second article conveyor means 20 is subject to the action of the piece wrapping means 40, comprising at least one transverse wrapping bar 41 which orbits around the said second article conveyor 20, passing through the said first opening A1 and the said second opening A2, in which the opposite ends of the said bar 41 are supported by two corresponding chains 42*a* and 42*b*, made to run along corresponding paths forming closed loops in corresponding vertical and longitudinal planes.

The chains 42*a* and 42*b* are driven by a first pair of sprockets 44*a* and 44*b* keyed on the ends of a single shaft which in turn is driven by a servo motor M40, preferably of the type with speed and phase control, such as a brushless servo motor with a servo control system, also connected to and controlled by the control means 70.

Piece Conveyor Means 50

The piece conveyor means 50, comprising a belt conveyor 51, preferably of the suction type, but in any case capable of gripping the pieces of packaging material in succession, are located in the area below the article conveyor 20, in the proximity of its entry end, the said piece conveyor means 50 being driven by a servo motor M50, preferably of the type with speed and phase control, such as a brushless servo motor with a servo control system, also connected to and controlled by the control means 70.

Optionally, sensor means 53 for detecting the front and rear ends of the pieces being conveyed can be positioned in the proximity of the downstream area of the conveying branch of the suction belt 51, these sensor means being connected to the control means 70, and, again optionally, sensor means 54, also connected to the control means 70, for detecting signs placed longitudinally along the pieces, these signs identifying the position of any printing present on the pieces, can be positioned in the same area.

First Modular Unit T100-G100 Located Downstream

Figures 3, 4:
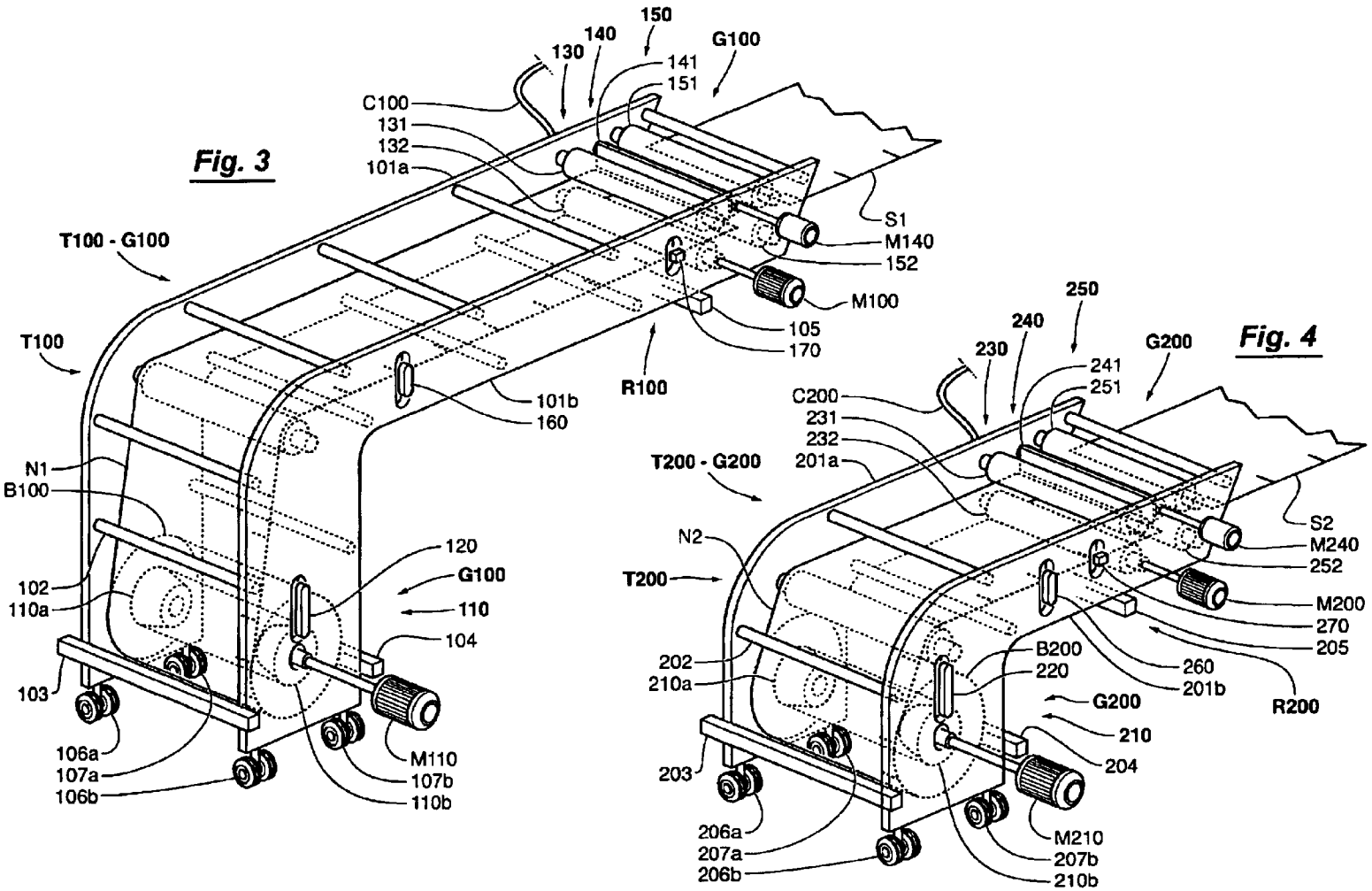
FIGS. 3 and 4 show schematically two modular units for forming and feeding pieces of sheet.

At the side of the piece conveyor means 50, a first modular unit T100-G100 is provided underneath the article conveyor means 10, comprising (see also FIG. 3) a supporting frame T100 and a piece forming and feeding unit G100, for forming and feeding pieces S1, connected to control means 70 by wiring C100.

The first frame T100 essentially comprises two vertical plates 101*a* and 101*b*, orientated longitudinally and vertically, shaped in the form of an "L" rotated through 90° clockwise, with the long side R100 projecting towards the conveyor belt 51, in which the said plates 101*a* and 101*b* are parallel to and spaced apart from each other and are joined together by a plurality of cross pieces 102, creating a frame with a self-supporting monolithic structure.

The said first modular unit T100-G100 is movable and positionable transversely with respect to the fixed frame of the base of the packaging machine, by means of a set of transversely slidable connections, such as a plurality of transverse bars fixed to the edges of the plates 101*a*–101*b*, and more particularly a bar 103 fixed to the rear edges, a bar 104 fixed to the front edges and a bar 105 fixed to the lower edges, in which, preferably, the end portions of the said bars 103, 104 and 105 extend outwards beyond the plates 101*a* and/or 101*b*.

The aforesaid slidable bars 104, 104 and 105 (see FIG. 1) are designed to slide over and/or inside corresponding fixed supports 103*s*, 104*s* and 105*s*, joined to the fixed frame of the base, for example two supports 103*s* and 104*s* fixed to the uprights and one support 105*s* fixed to the horizontal members.

The fixed frame with side walls Fa and Fb, in the form illustrated here by way of example, has at least one of its side walls Fb (FIG. 1) configured in such a way as to have an opening, delimited here by the inner edges B1, B2, B3, B4 and B5, in which the size of the said opening is such that the said first modular unit T100-G100 can slide freely transversely through it. It is preferable to provide a similar opening on the other wall Fa of the machine (see FIG. 2).

If necessary because of the weight to be supported, it is also possible to provide one or more lower supporting and running means, such as support wheels 106*a*–107*a* and 106*b*–107*b*, fixed on the lower edges of the plates 101*b* and 101*a*, in order to enable the said modular unit T100-G100 to be moved additionally away from the fixed frame.

A first piece forming and feeding unit G100, for forming and feeding, according to commands and under control, pieces S1 of sheet N1 towards and above the conveyor belt 51 of the piece conveyor means 50, is supported between the plates 101*a* and 101*b* of the said first frame T100.

The said first piece forming and feeding unit G100, which essentially comprises: reel support means 110, including two cones 111*a* and 111*b* which can be spaced apart transversely, for supporting the reel B100; sensor means 120, connected to the control means 70, including for example an optoelectronic and/or mechanical sensor, for determining the diameter of the reel B100; reel unwinding means 130, including a pair of counter-rotating rollers 131 and 132 between which the sheet N1 is placed; cutting means 140, including a rotary blade cutter 141 operated by an actuator M140 connected to the control means 70; piece feeding means 150 including a pair of counter-rotating rollers 151 and 152 between which the sheet/piece N1–S1 is placed, in which the said two pairs of rollers 131–132 and 151–152 are interconnected and operated by means of a servo motor M100, which is also connected to and controlled by the control means 70.

If required, because of the mass (inertia) of the reel B100 and/or because of the characteristics of the sheet N1 wound on the said reel B100 and/or for other reasons, it is also possible to provide a further servo motor M110, with speed and phase control, also connected to and controlled by the control means 70, for rotating in a controlled way at least one of the two cones which support and engage in the core of the reel B100, together with sensor means 160, of the optoelectronic and/or mechanical type for example and also connected to the control means 70, for determining the tension of the sheet N1, to enable the unwinding of the sheet to be optimized, preferably by action on the servo motor M110 and/or on the servo motor M100, and to facilitate the starting of the supply of the sheet, or the stopping of the supply of the sheet, as described more fully below.

If the packaging sheet N1 has longitudinal marks, for example marks used to identify the longitudinal position of printed patterns located in longitudinal succession on the same sheet, it is also possible to provide a further sensor 170, also connected to control means 70, located upstream of the rollers 131–132, for detecting the said marks and/or the said printed patterns, so that the printed pieces can be cut off correctly by the cutting means 140, 141, M140.

This structure essentially provides a first modular unit T100-G100, located under the article conveyor means 10, with the piece feeding branch R100 positioned at a first level and terminating in the proximity of the belt 51 of the piece conveyor means 50, in which the said first modular unit T100-G100 can move transversely without interfering with the other parts of the packaging machine, without any need to disconnect mechanical and/or electrical transmissions, and thus, essentially, can assume at least two transverse positions, namely a first position, defined here as the reel replacement and/or maintenance position, in which the said first modular unit T100-G100 is positioned transversely outside and at the side of the packaging line, or is moved away from the said packaging line, and a second position, defined here as the stand-by/operating position, in which the said first modular unit T100-G100 is positioned under the packaging line and fixed in position, so that it can form pieces of packaging material and feed them towards and on to the belt 51 of the piece conveyor means 50.

Second Modular Unit T200-G200 Located Upstream

A second modular unit T200-G200, comprising a frame T200 and a unit G200 for forming and feeding pieces S2, is provided at the side of the piece conveyor means 50 under the piece feeding branch R100 of the first modular unit T100-G100, and is connected to the control means 70 by wiring C200.

The said second modular unit T200-G200 is essentially identical to the first modular unit T100-G100, with the difference that its height and length are smaller. Consequently it will be described in a summary way below, using numbering similar to that of the preceding description.

The second frame T200 therefore comprises two vertical plates 201*a* and 201*b* and cross pieces 202, and is movable and positionable transversely with respect to the fixed frame by means of transversely slidable connections, such as a plurality of transverse bars 203, 204 and 205, fixed to the edges of the plates 201*a* and 201*b*, for sliding above and/or inside corresponding fixed supports 203*s*, 204*s* and 205*s* joined to the fixed frame of the base, which has at least one of its side walls Fb configured in such a way as to have an opening delimited by the inner edges C1, C2, C3, C4 and C5, to enable the said second modular unit T200-G200 to slide freely transversely through it. It is preferable to provide a similar opening in the other wall Fa of the machine.

If necessary, it is also possible to provide one or more lower support and transverse running means, such as supporting wheels 206*a*–207*a*, 206*b*–207*b* fixed on the lower edges of the plates 201*a* and 201*b*.

A second piece forming and feeding unit G200 is supported between the plates 201*a* and 201*b* of the said second frame T200, for presenting and feeding, on command, pieces S2 of sheet N2 towards and above the belt 51 of the piece conveyor means 50.

The said second piece forming and feeding unit G200 is essentially similar to the preceding first forming and feeding unit G100, and therefore has: reel support means 210, including two cones 211*a* and 211*b*; sensor means 220, connected to control means 70, including for example an optoelectronic and/or mechanical sensor, for determining the diameter of the reel B200; reel unwinding means 230, including a pair of counter-rotating rollers 231 and 232 between which the sheet N2 is placed; cutting means 240, including a rotary blade cutter 241 operated by an actuator M240 connected to the control means 70; piece feeding means 250 including a pair of counter-rotating rollers 251 and 252 between which the sheet/piece N2/S2 is placed, in which the said two pairs of rollers 231–232 and 251–252 are interconnected and operated by means of a servo motor M200, which is also connected to and controlled by the control means 70.

If required, because of the mass (inertia) of the reel B200 and/or because of the characteristics of the sheet N2 wound on the said reel B200 and/or for other reasons, it is also possible to provide a further servo motor M210, also connected to and controlled by the control means 70, for rotating in a controlled way at least one of the two cones which support the reel B200, together with sensor means 260, also connected to the control means 70, for determining the tension of the sheet while it is being unwound, to enable the unwinding of the sheet to be optimized, preferably by action on the servo motor M210 and/or on the servo motor M200, and to facilitate the starting of the supply of the sheet, or the stopping of the supply of the sheet, as described more fully below.

If the packaging sheet N2 has longitudinal marks, for example marks used to identify the longitudinal position of printed patterns located in longitudinal succession on the same sheet, it is also possible to provide a farther sensor 270, also connected to control means 70, located upstream of the rollers 231–232, for detecting the said marks and/or the said printed patterns, so that the printed pieces can be cut off correctly by the piece cutting means 240, 241, M240.

This structure essentially provides a second modular unit T200-G200, located under the piece feeding branch R100 of the first modular unit T100-G100, with the piece feeding branch R200 positioned at a second level and terminating in the proximity of the belt 51 of the piece conveyor means 50, in which the said second modular unit T200-G200 can also move transversely without interfering with the other parts of the packaging machine, without any need to disconnect mechanical and/or electrical transmissions, and thus, essentially, can assume at least two transverse positions, namely a first position, defined here as the reel replacement and/or maintenance position, in which the said second modular unit T200-G200 is positioned transversely outside and at the side of the packaging line, in other words is moved away from the said packaging line, and a second position, defined here as the stand-by/operating position, in which the said second modular unit T200-G200 is positioned under the packaging line and fixed in position, so that it can form pieces S2 of packaging material and feed them towards and on to the suction belt 51 of the piece conveyor means 50.

Control Means 70

The control means 70 can be of various types; for example they can comprise a programmable controller 71, consisting of a PLC and/or a computer and/or other equipment, a keyboard 72 and a monitor 73.

In the said controller 70, various programs are preferably stored, including, essentially, at least a first packaging cycle control program for monitoring and controlling the elements of the packaging machine which package the articles, together with, optionally, a second program which can run independently of the first program, for monitoring and controlling the elements of the first or the second modular unit T100-G100 or T200-0200, which form and feed the pieces S1 or S2, for reasons which are made clear below. If necessary, the second program can include two distinct programs for operating, respectively, with the first and the second modular unit T100-G100 and T200-G200.

Operation for Reel Changing and/or Maintenance

During the operation of the packaging machine, the pieces 2 for wrapping the articles 1 are fed by the modular unit T100-G100, in the case of pieces S1, or by the modular unit T200-G200, in the case of pieces S2, where the packaging operations are controlled by the control means 70, using the first packaging cycle program.

If, for example, the first modular unit T100-G100 is active, a sequence of single pieces S1 is fed progressively to the conveyor belt 51 of the piece conveyor means, and then towards the opening A1, in precise synchronization with the arrival of the articles 1, so that the known wrapping operations can then take place.

During the said stage of feeding by the first modular unit T100-G100, the second modular unit T200-G200, which is stationary, can be moved transversely to the side of the wall Fb, or away from the said wall Fb, for replacing the used reel B200 with a new reel and/or for clearing a jam and/or for carrying out maintenance and/or for other reasons.

To replace a reel, the operator removes the used reel and its sheet, and then inserts a new reel and inserts the new sheet along the unwinding path and between the rollers 231–232 and 251–252, making a specified length of the front end of the said sheet N2 project beyond the said last rollers 251–252.

In this context it should be emphasized that all these operations are carried out easily and without risk of accident, since the modular unit T200-G200 is positioned at the side of, or away from, the packaging machine, which continues to operate.

Optionally, the operator can also dissociate the said second modular unit T200-G200 from the packaging cycle control program before starting the aforesaid operations, in order to be able to operate the servomotors M200 and/or M210 and/or the actuator M240 independently, to facilitate the execution of the subsequent operations, such as the removal of the used and/or jammed sheet, by reversing the rotation of the various working parts, or the unwinding and positioning of the new sheet N2, by operating the said working parts separately. The operator can also, again optionally, run the second piece forming control program after having positioned the new sheet and its reel, in order to execute a few cycles of forming and feeding the pieces automatically, for the purpose of checking the correct running of the sheet, the correctness of forming of the pieces, the correctness of the length of the sheets, and so on, and also, if required, in order to check the correctness of the positioning of the cutting line with respect to the printed patterns, or in other words, essentially, to test fully and exhaustively in real conditions and in regular operation, in other words with the new sheet in tension, the correctness of the setting of the said second modular unit T200-G200, before it is used in the packaging cycle, as described more fully below.

When the second modular unit T200-G200 is correctly operating and set up, the operator reinserts it under the first modular unit T100-G100, positioning the front end of the sheet N2 in the proximity of the conveyor belt 51 of the piece conveyor means 50, so that the said second modular unit T200-G200 can be associated electronically by means of the keyboard 71 with the packaging cycle program, by entering a static prepared configuration, known as the "stand-by" configuration, for the said second modular unit T200-G200.

When the reel B100 of the first modular unit T100-G100 is about to run out, the sensor 120 sends a signal to the control means 70, which, because of the first packaging cycle control program, initially start the second unit G200 by means of the servo motor M200 (and the optional servo motor M210) in order to feed the pieces S2 on to the suction belt 51 and then, after a specified time interval, stop the first unit G100, by stopping the servo motor M100 (and the optional servo motor M110), in such a way as to feed a last piece S1 on to the suction belt 51. The aforesaid time interval is preset according to the length of the pieces and the transport speed of the piece conveyor means 50, in order to obtain, on the conveyor belt 51, an interval of space between the last piece S1 and the first piece S2 essentially equal to that which was formerly present between the pieces S1-S1.

In this context, the succession of pieces on the suction belt 51 can optionally be monitored, even during the reel changing stage, by the sensor 53, which detects the front and rear ends of the pieces S1, S2 being fed, and then sends the corresponding signals to the control means 70, which, if the said signals indicate an incorrect distance within the succession of pieces, for example if the front end of the piece S2 is leading or lagging, proceed to accelerate or decelerate the piece conveyor means 50, by means of the servo motor M50, in order to keep a constant correct synchronization in the proximity of the opening A1 between the pieces S1 or S2 and the corresponding articles 1, thus producing correctly formed packages.

If the speed of the piece conveyor means 50 is to be modified, the said control means 70 can also, where necessary, modify the speed of the two pairs of unwinding and feeding rollers 231–232 and 251–252, and can change the synchronization of the cutting means 140 by acting, respectively, on the servo motor M200 and on the actuator M240. On completion of the correction, the packaging machine can return to operation at the optimal regular speed.

If the second modular unit T200-G200 is optionally provided with the servo motor M210, for rotating the reel B200, the control means 70 cause the previously stationary reel B200 to rotate, in order to facilitate the said stage of the start of forming and feeding of the pieces S2. After the said initial starting stage, during regular operation, the said control means 70 controls the speed of the said servo motor M210 according to the said signals received by means of the sensor 260 which measures the tension of the sheet N2 and communicates this to the control means 70, in order to optimize the unwinding of the sheet N2.

If the packaging sheet is printed, the advance of the printing on each piece along the path of its movement towards the first opening A1 on the suction belt 51 is optionally determined by the sensor 54, which detects the corresponding marks positioned longitudinally along the pieces, and then sends the corresponding signals to the control means 70, which, if the said signals indicate incorrect synchronization between the printing on the pieces S1 and S2 and the corresponding articles 1 moving towards the said first opening A1, accelerate or decelerate the piece conveyor means 50 by means of the servo motor M50, in order to restore the correct synchronization, and thus place the said printing in the correct positions on the faces of the articles 1 to be packed.

During the said stage in which the pieces are formed and fed by the second modular unit T200-G200, the first modular unit T100-G100 can be moved transversely to the side of the wall Fb, or away from the said wall Fb, to replace the used reel B100 with a new one and/or to clear a jam and/or to carry out maintenance and/or for other reasons, and it can also, optionally, be dissociated electronically from the first packaging cycle control program of the packaging machine.

Clearly, therefore, all the operations described above in relation to the second modular unit T200-G200 can also be executed easily for the said first modular unit T100-G100; this is applicable, for example, to reel changing, repairs, maintenance, etc., as well as to testing in real conditions in which a number of pieces are produced by running and applying the second piece forming program.

When the first modular unit T100-G100 is correctly set up and operational, the operator reinserts it under the article conveyor 10, bringing the front end of the sheet N1 into the proximity of the suction belt 51 of the piece conveyor means 50, and then using the keyboard 71 to electronically associate the said first modular unit T100-G100 with the packaging cycle control program, entering a "ready" configuration, known as the "stand-by" configuration, for the said first modular unit T100-G100.

When the reel B200 of the second modular unit T200-G200 is about to run out, the sensor 220 sends a signal to the control means 70, which, as a result of the first preloaded program, initially stop the second unit G200 by means of the servo motor M200 (and the optional servo motor M210) in order to feed a last piece S2 on to the suction belt 51, and then, after a specified time interval, start the first unit G100 by starting the servo motor M100 (and the optional servo motor M110), where the aforesaid time interval is preset according to the length of the pieces and the transport speed of the piece conveyor means 50, in order to obtain on the conveyor belt 51 a distance between the last piece S2 and the first piece S1 which is essentially equal to that which was formerly provided for the pieces S2-S2.

In this context, the succession of pieces positioned on the suction belt 51 can be optionally monitored by the sensor 53 and/or monitored by the sensor 54, so that all the operations indicated above in relation to the previous reel change can be carried out.

Changing the Format

With reference to the above description, the system according to the present invention is also particularly useful for changing formats and other operations.

This is because, in the case of format changing, while one modular unit is used for forming and feeding pieces designed to finish the packages in the preceding format, the other modular unit can be prepared for the new format by entering the new parameters for the different format in the corresponding piece forming program and then checking the setting and functionality of the said last modular unit for producing the new format, by executing the forming of a number of pieces in the new format with the corresponding piece forming program, and then inserting the said additional modular unit into the packaging machine, in order to carry out the change of format rapidly as soon as the packaging operations in the preceding format have been completed, by operating the said additional modular unit with the new format in place of the preceding one.

Making Repairs

In relation to other applications of the system according to the present invention, it should also be emphasized that, if the sheet of packaging material breaks and/or if any of the piece forming and feeding elements fail and/or for other reasons, it is possible to resume the packaging operations immediately by using the other, operational modular unit, and then to move the faulty modular unit to the side of the machine in order to make the necessary repairs and/or carry out the corresponding maintenance, and then to test, in real and regular conditions, in other words with the sheet under tension and running, the correctness of operation of the repaired unit.

Execution of Differential Feeding

Again in relation to other applications of the system according to the present invention, we would emphasize the distinctive ability of the said system to package a succession of articles with pieces of different types.

This is because, in the case in question, the first modular unit T100-G100 is fitted with a first reel B100 and a corresponding first sheet N1 which are different from a second reel B200 and a corresponding second sheet N2 with which the second modular unit T200-G200 is fitted.

With this set-up, the synchronizing means 70, as a result of a special previously loaded packaging cycle control program, operate the first and second modular units T100-G100 and T200-G200 in an alternating way, in which the change from one to the other takes place in the way indicated above in relation to the reel change, in such a way that a specified sequence of different pieces is obtained on the conveyor belt 51 of the piece conveyor means 50, for example a first sequence S1-S2-S1-S2 etc., or a second sequence S1-S1-S2-S1-S1-S2 etc., or a another type of sequence, in which the said pieces are then wrapped by wrapping means 40 around the articles 1, thus producing, respectively, a first sequence of product and package assemblies 1-S1, 1-S2, 1-S1, 1-S2, etc., or a second sequence of product and package assemblies 1-S1, 1-S1, 1-S2, 1-S1, 1-S1, 1-S2, etc., or another type of sequence.

The above description of the system is provided purely by way of example and without restrictive intent, and therefore it can clearly be subjected to all modifications or variations suggested by experience or by its use or application, within the scope of the following claims, which form an integral part of the present description.

What is claimed is:

1. System for a sleeve-type packaging machine, which wraps pieces (2) of packaging material around articles (1), in which the said packaging machine comprises: first article conveyor means (10), for feeding the articles (1) longitudinally in sequence and spaced apart from each other; second article conveyor means (20), located downstream and at a small distance from said first article conveyor means (10), thus creating a first opening (A1) between said first (10) and said second (20) article conveyor means, the second article conveyor means being able to receive the articles arriving from said first article conveyor means (10) and to carry said articles (1) along a wrapping plane which has an entry end and an exit end; third article conveyor means (30), located downstream and at a small distance from said second article conveyor means (20), thus creating a second opening (A2) between said second (20) and said third (30) article conveyor means, the third article conveyor means being able to receive the articles (1) arriving from said second article conveyor means (20); means (40) for wrapping the pieces of sheet, located in the proximity of said second article conveyor means (20), and comprising at least one suspended wrapping bar (41), oriented transversely with respect to the direction of advance of the articles (1), and made to move through said first (A1) and said second (A2) opening along an orbital path passing over the top of said second article conveyor means (20), the bar being capable of carrying the pieces (2) of wrapping material; piece conveyor means (50) with a conveyor belt (51), positioned longitudinally below and in alignment in the proximity of said first opening (A1), for feeding the pieces (2) of packaging material in the proximity of said first opening (A1); and control means (70) comprising a first modular unit (T100-G100) which is located under the first article conveyor means (10) and is movable and positionable with respect to the packaging machine, for forming and feeding pieces (S1) of packaging material, said first modular unit being functionally connected to the control means (70); a second modular unit (T200-G200) which is located under the first article conveyor means (10) and is movable and positionable with respect to the packaging machine, for forming and feeding pieces (S2) of packaging material, said second modular unit being functionally connected to the control means (70); and said first modular unit (T100-G100) and said second modular unit (T200-G200) assume at least two positions, namely a first position in witch the modular unit (T100-G100; T200-G200) is positioned at least transversely at the side of the packaging machine, and a second position, in which the modular unit (T100-G100; T200-G200) is positioned under the packaging machine in order to feed the pieces (S1, S2) towards and above the conveyor belt (51) of the piece conveyor means (50).

2. System according to claim 1, characterized in that the said first modular unit (T100-G100) comprise a frame with lateral plates (101*a*–101*b*) which are parallel, interconnected and spaced apart from each other, and the following components are supported between the said plates (101*a*–101*b*): support means (110) for supporting a reel (B100) of packaging sheet (N1); first sensor means (120) for detecting when the reel (B100) has been used up; unwinding means (130) for unwinding the sheet (N1) wound on the reel (B100), cutting means (140) for cutting the sheet (N1), and feed means (150) for feeding the pieces (S1) towards and above the conveyor belt (51).

3. System according to claim 2, characterized in that the said control means (70) modify the speed of the unwinding means (130; 230) and the speed of the feed means (150; 250) with respect to the speed of the piece conveyor means (50).

4. System according to claim 3, characterized in that the unwinding means (130; 230) and the feed means (150; 250) are driven by a corresponding servo motor M100; M200) connected to the control means (70) and said control means (70) modify the speed of the said servo motor (M100; M200) of the unwinding means (130; 230) and of the feed means (150; 250).

5. System according to claim 2, characterized in that the said first modular unit (T100-G100) and the said second modular unit (T200-G200) include additional corresponding third sensor means (170; 270) for detecting marks located along the sheet (N1, N2), said third sensor means (170; 270) are connected to the control means (70), said cutting means (140; 240) are operated by an actuator (M140; M240) connected to and controlled by the control means (70), and said control means (70) are able to drive the actuator (M140; M240) of the cutting means (150; 250) in synchronization with the position reached by the sheet (N1; N2) as detected by the aforesaid third sensor means (170; 270), in order to cut the pieces in a specified longitudinal position with respect to the said marks.

6. System according to claim 2, characterized in that the said first modular unit (T100-G100) and the said second modular unit (T200-G200) include additional respective fifth sensor means (160; 260) connected to the control means (70) for detecting the tension of the sheet (N1; N2) being unwound, said first modular unit (T100-G100) and the said second modular unit (T200-G200) include additional respective servo motors (M110, M210) for rotating the respective reels (B100; B200), and said control means (70) use the said servo motors (M110, M210) of the reels (B100; B200) to control the rotation of the respective reels (B100; B200) according to the signals received from the aforesaid fifth sensor means (160; 260).

7. System according to claim 1, characterized in that the said second modular unit (T200-G200) comprise a frame with lateral plates (201*a*–201*b*) which are parallel, interconnected and spaced apart from each other, and the following components are supported between the said plates (201*a*–201*b*): support means (210) for supporting a reel (B200) of packaging sheet (N2); first sensor means (220) for detecting when the reel (B200) has been used up; unwinding means (230) for unwinding the sheet (N2) wound on the reel (B200), cutting means (240) for cutting the sheet (N2), and feed means (250) for feeding the pieces (S2) towards and above the conveyor belt (51).

8. System according to claim 1, characterized in that additional second sensor means (53) are provided along the transport branch of the piece conveyor means (50) for detecting the front and rear edges of the pieces (S1; S2) being fed towards the said first opening (A1), and said second sensor means (53) are connected to the control means (70).

9. System according claim 1, characterized in that the said control means (70) are able to modify the motion of the said piece conveyor means (50) with respect to the motion of the article conveyor means (10, 20, 30) in order to produce the correct synchronization between the said pieces (S1; S2) being moved towards the said first opening (A1) and the articles (1) being moved towards the same first opening (A1).

10. System according to claim 9, characterized in that the said piece conveyor means (50) are driven by a corresponding servo motor (M50) connected to the control means (70) and said control means (70) are able to modify the speed of the said servo motor (M50) of the conveyor means (50).

11. System according to claim 1, characterized in that additional fourth sensor means (54) are provided along the transport branch of the piece conveyor means (50), for detecting marks located longitudinally along the pieces (S1; S2), said fourth sensor means (54) are connected to the control means (70), and said control means (70) are able to modify the motion of the said piece conveyor means (50) with respect to the motion of the article conveyor means (10, 20, 30) in order to produce the correct synchronization between the said pieces (S1; S2) being moved towards the said first opening (A1) and the articles (1) being moved towards the same first opening (A1).

12. System according to claim 1, in which the fixed frame (1) of the packaging machine has two walls (Fa, Fb), characterized in that it comprises in the said walls (Fa, Fb) at least a first opening (B1, B2, B3, B4, B5) of sufficient size to allow the free transverse sliding of the first modular unit (T100-G100) and at least a second opening (C1, C2, C3, C4, C5) for allowing the free transverse sliding of the second modular unit (T200-G200).

13. System according to claim 1, characterized in that the said first modular unit (T100-G100) and the said second modular unit (T200-G200) feed the pieces (S1, S2) in two separate areas located respectively upstream and downstream on the working branch of the conveyor belt (51) of the piece conveyor means (50), for a change of reel from the first modular unit (T100-G100) to the second modular unit (T200-G200) the said second modular unit (T200-G200) is operated for a specified period before stopping the first modular unit (T100-G100), and for a change of reel from the second modular unit (T200-G200) to the first modular unit (T100-G100) the said second modular unit (T200-G200) is stopped and the first modular unit (T100-G100) is operated after a specified period following this stop.

14. System according to claim 1, characterized in that a first modular unit (T100-G100) is positioned under the article conveyor means (10) with the branch (R100) for feeding the pieces (S1) positioned at a first level and terminating in the proximity of the belt (51) of the piece conveyor means (50) and a second modular unit (T200-G200) is positioned under the said piece feeding branch (R100) of the first modular unit (T100-G100) with the branch (R200) for feeding the pieces (S2) positioned at a second level below the aforesaid branch (R100) and terminates in the proximity of the belt (51) of the piece conveyor means (50).

15. System according to claim 1, characterized in that the said control means (70) include a packaging cycle control program, the modular units (T100-G100; T200-G200) dissociated functionally from the packaging cycle control program, and after this dissociation the various working elements (110, M110, 130, 140, M140, 150, M100; 210, M210, 230, 240, M240, 250, M200) of the dissociated modular unit (T100-G100 or T200-G200) operated singly and independently.

16. System according to claim 1, characterized in that the said control means (70) include a first packaging cycle control program and a second piece forming control program, said second piece forming program can run independently of the first packaging cycle control program, the modular units (T100-G100; T200-G200) are dissociated functionally from the first packaging cycle control program, and after this dissociation the said second piece forming program is designed to operate and control the working elements (110, M110, 120, 130, 140, M140, 150, M100, 160; 210, M210, 220, 230, 240, M240, 250, M200, 260) of the first or the second dissociated modular unit (T100-G100 or T200-G200) in order to form and feed pieces (S1 or S2).

17. System according to claim 16, characterized in that the said second piece forming control program is used to enter new parameters for changing the format of the pieces which are to be produced.

18. System according to claim 1, characterized in that the said control means (70) include a packaging cycle control program, said first modular unit (T100-G100) or the said second modular unit (T200-G200) for forming and feeding the pieces (S1; S2) additionally includes respective servo motors (M110, M210) for rotating the respective reel (B100; B200), and during the change of reel the packaging cycle control program rotates the new reel (B100; B200) by activating the corresponding servo motor (M110; M210) of the reels (B100; B200).

19. System according to claim 1, characterized in that the said control means (70) include a packaging cycle control program, said first modular unit (T100-G100) or the said second modular unit (T200-G200) for forming and feeding the pieces (S1; S2) additionally includes respective servo motor (M110, M210) for rotating the respective reel (B100; B200), and during the change of reel the packaging cycle control program stops the corresponding used reel (B100; B200) by activating the corresponding servo motor (M110; M210) of the reels (B100; B200).

20. System according to claim 1, characterized in that the said control means (70) include a packaging cycle control program, said first modular unit (T100-G100) or the said second modular unit (T200-G200) for forming and feeding the pieces (S1; S2) additionally include respective sixth sensor means (160; 260) for detecting the tension of the sheet (N1; N2) being unwound, said sixth sensor means (160; 260) are connected to the control means (70), said first modular unit (T100-G100) or the said second modular unit (T200-G200) for forming and feeding the pieces (S1; S2) additionally include respective servo motor (M110, M210)

for rotating the respective reel (B100; B200), and said packaging cycle control program controls the said servo motor (M110; M210) of the reels (B100; B200) in order to optimize the unwinding of the sheet (N1; N2) from the corresponding reel (B100; B200).

21. System according to claim 1, characterized in that the first modular unit (T100-G100) is fitted with a first reel (B100) and a corresponding first sheet (N1), the second modular unit (T200-G200) is fitted with a second reel (B200) and a corresponding second sheet (N2) which are different from the first reel (B100) and the first sheet (N1), and in that a packaging cycle control program is provided which operates the first and second modular units (T100-G100, T200-G200) alternately, in such a way that a specified sequence of different pieces (S1-S2-S1, etc., or S1-S1-S2-S1-S1-S2, etc.) is formed on the conveyor belt (51) of the piece conveyor means (50).

22. System according to claim 1, characterized in that a first servo motor (M10), connected to and controlled by the control means (70), for driving said article conveyor means (10, 20, 30); a second servo motor (M40), connected to and controlled by the control means (70), for driving said wrapping means (40); a third servo motor (M50), connected to and controlled by the control means (70), for driving said piece conveyor means (50); and a fourth and fifth servo motors (M100; M200), connected to and controlled by the control means (70), for driving, respectively said first and said second modular units (T100-G100; T200-G200).

* * * * *